United States Patent [19]

Shaffer et al.

[11] 4,190,413

[45] Feb. 26, 1980

[54] PHOTOFLASH LAMP

[75] Inventors: John W. Shaffer; Daniel W. Bricker, both of Williamsport, Pa.

[73] Assignee: GTE Sylvania Incorporated, Stamford, Conn.

[21] Appl. No.: 865,987

[22] Filed: Dec. 30, 1977

[51] Int. Cl.[2] ..... F21K 5/02

[52] U.S. Cl. ..... 431/362; 149/37; 102/28 R

[58] Field of Search ..... 431/362, 358, 357, 362; 149/37, 19.8; 102/28 R, 28 M

[56] References Cited

U.S. PATENT DOCUMENTS

| | | | |
|---|---|---|---|
| 2,995,086 | 8/1961 | Scott | 102/28 M |
| 3,041,862 | 7/1962 | Anderson et al. | 431/362 |
| 3,048,507 | 8/1962 | Zebree | 102/28 M |
| 3,318,243 | 5/1967 | Miller | 102/28 M |
| 4,059,388 | 11/1977 | Shaffer | 431/362 |
| 4,059,389 | 11/1977 | Armstrong et al. | 431/362 |
| 4,061,511 | 12/1977 | Baczok | 149/19.8 |
| 4,080,155 | 3/1978 | Sterling | 431/359 |

FOREIGN PATENT DOCUMENTS

| | | | |
|---|---|---|---|
| 154282 | 2/1953 | Australia | 149/37 |
| 27267 | 1/1905 | Fed. Rep. of Germany | 149/37 |

*Primary Examiner*—Charles J. Myhre
*Assistant Examiner*—R. A. Nelli
*Attorney, Agent, or Firm*—Edward J. Coleman

[57] ABSTRACT

A high-voltage type photoflash lamp having an ignition structure including an improved primer material with enhanced breakdown voltage characteristics for the reliable ignition of filamentary combustible material distributed within the oxygen-filled envelope of the lamp. The primer material comprises a particulate fuel such as zirconium powder, a binding agent such as nitrocellulose, and an additive of relatively coarse inert material which is nonconductive and insoluble in the vehicle used in the applied slurry. A preferred additive consists of glass microbeads having a particle size substantially larger than the zirconium powder used.

13 Claims, 3 Drawing Figures

PHOTOFLASH LAMP

BACKGROUND OF THE INVENTION

This invention relates to photoflash lamps and, more particularly to flashlamps of the type containing primer material ignited by a high voltage pulse.

Such flashlamps typically comprise a tubular glass envelope constricted and tipped off at one end and closed at the other end by a press seal. A pair of lead-in wires pass through the glass press and terminate in an ignition structure including a glass bead, one or more glass sleeves, or a glass reservoir of some type. A mass of primer material contained on the bead, sleeve or reservoir bridges across and contacts the ends of the lead-in wires. Also disposed within the lamp envelope is a quantity of filamentary metallic combustible, such as shredded zirconium or hafnium foil, and a combustion supporting gas, such as oxygen, at an initial fill pressure of several atmospheres.

An improved ignition structure, which provides excellent lamp reliability and substantial economies and ease of automated manufacture, is the so-called fritted lead construction described in U.S. Pat. No. 4,059,389, of Donald E. Armstrong et al. This is a beadless ignition structure comprising a pair of spaced-apart lead-in wires with spherically shaped terminations, a glass frit coating over the lead-in wires, and a coating of primer material over the frit-coated terminations. The primer may bridge the wire terminations or comprise separate spaced apart coatings on the respective terminations, with the filamentary combustible (shredded foil) being in contact with both terminations to provide a conducting path there between. A primer composition is described which comprises about 99.0 percent by weight of zirconium powder and 1.0 percent by weight cellulose nitrate on a dried basis.

Lamp functioning is initiated by application of a high voltage pulse (e.g., several hundred to several thousand volts, for example, from a piezoelectric crystal in a camera) across the lamp lead-in wires. The dielectric primer coatings within the lamp then break down electrically and ignite; the resulting deflagration, in turn, ignites the shredded combustible which burns actinically.

Normal lamp-to-lamp variations as well as varying degrees of intimacy of contact between primered leads and shredded combustible gives rise to a wide range of lamp firing or breakdown voltages. So long as the maximum lamp breakdown voltage is below the output pulse voltage of the camera the lamps will operate reliably. The maintaining of a suitable control of the upper limit of lamp breakdown voltage in automated lamp production has not been a problem.

Prior to use of the present invention, some lamps tended to have very low breakdown voltages; values as low as 50 volts sometimes being encountered. Such lamps tended to be undesirably sensitive toward inadvertent ignition by stray electrostatic charges both during manufacture and use. Also, there have now appeared on the market cameras that give voltages to the flash socket at times other than during actual picture taking. These spurious camera pulses are generally below 100 volts but can, however, give rise to inadvertent flashing and lamp loss under certain conditions when used together with lamps having very low breakdown voltages. A minimum breakdown voltage of about 200 is therefore desirable.

In an effort to retain the desirable fritted lead lamp construction, and at the same time elevate the low end of the breakdown voltage distribution, a number of possible lamp changes have been considered. For example, the application of a thicker frit coating raises the average breakdown as well as the maximum values found. Although the percentages of low voltage lamps is reduced, some lamps remain that break down below 100 volts. Provision of a sufficiently heavy frit coating to give a minimum breakdown voltage of 200 volts at the same time gives some lamps of such high voltage that reliability might suffer with certain camera models.

While it should be theoretically possible to exercise some control of shred contact with the primer-coated leads and thereby influence breakdown voltage, in practice this does not appear feasible. The mere shipping and handling of flashlamps causes movement and relocation of the mass of shredded combustible.

U.S. Pat. No. 4,059,388 of John W. Shaffer, describes a primer material comprising a mixture of combustible metal powder (zirconium), an additive of one of more metal oxides which are electrically non-conductive but combustion-supporting, such as $WO_3$, and a binding agent, but which is free of oxidizer salts. The metal oxides function as an oxygen donor and do increase the breakdown voltage somewhat. The elevation of breakdown voltage attainable through such oxide addition alone, however, is insufficient to give lamp populations essentially free of lamps with less than a 200-volt minimum.

A copending application Ser. No. 744,540, Daniel W. Bricker et al, filed Nov. 24, 1976 and assigned to the present assignee, describes a primer material which includes submicron sized refractory particle additives, such as fumed silica, which are extremely fine compared to the powdered fuel particles (zirconium). This additive does not increase breakdown voltage significantly but does render the primer more sensitive to low energy discharges. Thus its use, while beneficial from the standpoint of rendering lamp reliability and ignition sensitivity independent of the zirconium powder lot used, actually increased the tendency toward inadvertent electrostatic ignition.

Another U.S. Pat. No. 3,972,673 of Schupp, describes a primer material which comprises a solid mixture of combustible fuel, an oxidizer for the fuel, such as an alkali metal chlorate or perchlorate, and a combustion supporting oxide of the type which is converted to a lower oxide upon combustion of the mixture. More particularly, the Schupp patent indicates that certain metal oxide additives in this solid primer mixture promote a more complete combustion of the primer fuel. It is hypothesized that the additive is partially reduced through chemical reaction taking place when the lamp is flashed to provide a source of oxygen which is readily available for combustion of the primer fuel by reason of the oxygen being generated in the solid mixture. The specific combustion-supporting oxides indicated as suitable for this application comprise $Co_3O_4$, $BaCrO_4$, $Fe_2O_3$, and the higher oxides of nickel. A preferred primer material composition is given as comprising a solid mixture, in percentages by weight, of 46.1 percent zirconium, 14.5 percent sodium chlorate, 31.7 percent $Co_3O_4$, and 7.7 percent $BaCrO_4$, and further containing between 1-5 percent of water soluble polymer binder such as polyvinyl alcohol or polyvinyl pyrrolindone.

These materials are dispersed in water to provide a wet paste for manufacturing use.

A later filed, but earlier issued, patent of Schupp, namely, U.S. Pat. No. 3,969,067, describes an improvement over the primer material discussed above in that the composition further includes an alumina gel additive in an amount from about 0.25–2.0 percent by weight of the solid mixture. The patent indicates that this additive modifies the operation of the primer material to promote less sensitivity to premature accidental ignition from ambient electrostatic charges without requiring an increase in the maximum energy provided by the firing pulse. In particular, the patent indicates that the alumina gel additive can be dispersed in the primer composition with the effect of increasing the average breakdown voltage characteristic of the dried primer. A water slurry of alumina gel would be immiscible in an organic solvent mixture suitable for use with a nitrocellulose binder. Hence, this approach to the minimum breakdown voltage problem appears to be somewhat limited as to choice of additive materials and the solvent employed in providing a liquid dispersion for application to ignition structures in lamp manufacturing. Further, the amount of additive employed appears quite critical. The patent indicates that increased alumina gel concentration in the primer mixture raises the breakdown voltage level approximately 200 volts for each one percent by weight addition of the additive. Accordingly, the production control required to avoid unacceptably high breakdown voltage levels with fritted lead lamps would appear to be somewhat undesirable for low cost, high speed automated manufacturing processes.

SUMMARY OF THE INVENTION

In view of the foregoing, it is an object of this invention to provide an improved photoflash lamp with a reliable ignition means having enhanced breakdown voltage characteristics.

A particular object of the invention is to provide a primer for high voltage type photoflash lamps that exhibits a more controlled breakdown voltage range, with a substantially reduced incidence of lamps having undesirably low breakdown voltages, while maintaining good flash reliability.

Another object is to provide such a primer in an inexpensive, production-acceptable manner which is applicable to a wide range of primer compositions.

These and other objects, advantages and features are attained, in accordance with the principles of this invention, by the discovery that an elevation of both the average and low limit of primer breakdown voltage can be obtained, without diminishing flash reliability, by the addition of relatively coarse, electrically nonconducting inert particulate material to the primer composition. Surprisingly, the effect appears rather selective in that the low end of the breakdown voltage range is influenced more than is the high end of the range. For example, the addition of glass microbeads having an average particle size of 30 microns diameter to a primer including powdered zirconium fuel having an average particle size of 1.2 microns diameter has, for the first time, made possible the manufacture of the aforementioned fritted lead lamps with the capability of the virtual elimination of lamps with a breakdown voltage below 200 volts. In general, the additive material may comprise glasses, silica, refractory oxides and other materials which are insoluble in the vehicle used in providing a liquid dispersion. Hence, there is a broad choice of additive materials suitable for use with a wide variety of aqueous or organic solvents.

Preferably, the solid particle size of the additive material is about 10 to 50 times larger in diameter than the particle size of the particulate fuel used in the mixture, and the additive is present in an amount from about 10 to 60 weight percent of the dried mixture. As discussed above, the principal effect of the additive is to reduce the number of lamps with low breakdown voltage and thereby change the breakdown voltage distribution for any given population. It is felt that this effect results from the lengthening of the breakdown path through the primer, such path probably following the interparticle channels formed by the coarse nonconducting additive.

It is to be noted that the present additive comprises relatively large solid particles, whereas the previously mentioned alumina gel consists of porous gel structure of very fine ultimate particle size. Further, the comparatively large proportion of additive employed reduces the criticality of the amount of additive in the mixture and, thereby, results in an improved primer mixture which is more compatible with automated production processes than the previously referenced alumina gel additive. The large proportion of additive with a coarse solid particle size yields an additional benefit which results from the lowered average quantity of combustible metal powder (fuel) used per lamp. Such particle diluted primers results in a freeing of gaseous oxygen for reaction with the shredded combustible in the lamp. This benefit is primarily realized with the safe primers which are free of oxidizer salts.

BRIEF DESCRIPTION OF THE DRAWINGS

This invention will be more fully described hereinafter in conjunction with the accompanying drawings, in which.

DESCRIPTION OF PREFERRED EMBODIMENT

Figure 1:
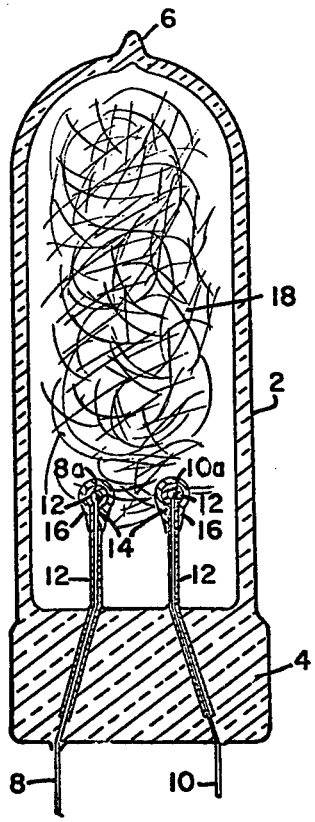
FIG. 1 is an enlarged sectional view of one embodiment of a photoflash lamp in accordance with the invention, wherein primer coatings on the lead-in wires are spaced apart without bridging.
Figure 2:
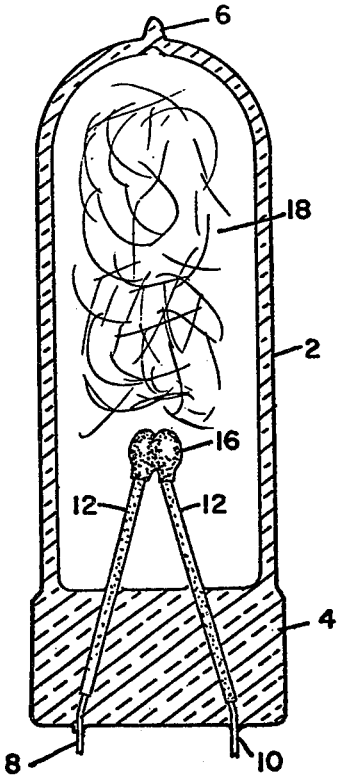
FIG. 2 is an enlarged sectional view of a variation of the lamp of FIG. 1, wherein the lead-in wires are bridged with primer.

FIGS. 1 and 2 illustrate fritted lead photoflash lamps of the type described in the aforementioned U.S. Pat. No. 4,059,389, except that the primer material 16 has a composition in accordance with the present invention. Referring to FIG. 1, the high voltage type flashlamp illustrated therein comprises an hermetically sealed light-transmitting envelope 2 of glass tubing having a press 4 defining one end thereof and an exhaust tip 6 defining the other end thereof. Supported by the press 4 is an injection means including a pair of metal lead-in wires 8 and 10 extending through and sealed into the press in a spaced apart relationship. The ends of the lead-in wires within the envelope are provided with smooth and rounded terminations **8*a* and 10*a* of substantially spherical shape. The diameter of each termination preferably is about 2 to 3 times the diameter of the remainder of the wire. The surface of the lead-in wires and their terminations in the envelope are coated with an insulating material of glass frit 12. The frit glass should have a mean coefficient of thermal expansion which substantially matches that of the glass envelope 2, and preferably, the glass compositions of the frit and the envelope are the same. In this manner a good glass-to-metal seal is provided in the press area 4, where the frit coating 12** typically extends along the leads.

A selected portion 14 on each lead-in wire adjacent to the spherical termination thereof may be uncoated with the glass frit insulating material so as to expose a small area of bare metal wire through coating 12. The ignition structure is completed by a coating of primer material 16 over the spherical terminations 8*a* and 10*a* and portions of the adjacent wire. More specifically, the primer material 16 is disposed over the glass frit coating 12 and must cover any uncoated bare wire portions 14. The respective coatings of primer material 16 on the lead-in wires 8 and 10 are spaced apart from each other. FIG. 2 illustrates an alternative approach wherein the primer material 16 bridges the terminations of the lead-in wires.

Typically the lamp envelope 2 has an internal diameter of less than one centimeter and an internal volume of less than one cubic centimeter. A quantity of filamentary combustible fill material 18, such as shredded zirconium or hafnium foil, is disposed within the lamp envelope. The envelope 2 is also provided with a filling of combustion supporting gas such as oxygen at a pressure of several atmospheres. Typically, the exterior surface of the glass envelope 2 is also provided with a protective coating such as cellulose acetate (not shown).

In accordance with the present invention, we have discovered that a reliable primer with an enhanced breakdown voltage can be provided by the use of an additive of relatively coarse inert particulate material which is insoluble and non-conductive and has a particle size substantially larger than that of the combustible powdered fuel. For example, primer material 16 may be provided by mixing a particulate fuel, typically a combustible metal powder such as zirconium, with a larger percentage of the inert additive, and a binding agent such as nitrocellulose in a suitable solvent, for example, methyl cellosolve. The resultant primer mixture is then applied, such as by a dip process. For example, after press sealing the lead-in wires into the lamp and prior to filling with shreds and oxygen, the end portions of the frit coated lead-in wires are dipped into a primer cup which passes through the open end of the glass tubing, so as to apply the coating 16 of the primer material about the wire terminations, as shown in FIGS. 1 and 2. When dried, the primer shows substantially increased ignition sensitivity for high voltage discharge therethrough.

Alternatively, a thermite-type primer, such as described in U.S. Pat. No. 4,059,388, may be employed. In this instance, the above noted primer mixture further includes one or more metal oxides from the group of metals comprising cobalt, tungsten, manganese, nickel and/or copper. The proportion of metal oxides can be from about 1 to 130 percent of the stoichiometric quantity required for chemical reaction with the combined metal fuels in the mixture. That is, the amount of metal oxide used should fall within plus 30 percent or minus 99 percent of the calculated stoichiometric quantity required for thermite-type reaction with all the metal powder used. This thermite-type reaction composition increases the breakdown voltage of the primer as compared to oxidizer free primers so as to preclude inadvertent simultaneous flashing of array lamps due to high voltage leakage paths in the interconnecting structure of the circuitry. The fuel portion of the mixture may also include magnesium powder as an additive to lower the electrical breakdown voltage where some degree of adjustment to the electrical voltage sensitivity of the primer is desired. For example, magnesium powder content may be from 0 to 30 percent by weight on a dried basis.

Yet a further alternative, although not as desirable, comprises the use of an oxidizer, such as sodium chlorate or potassium chlorate, along with the mixture of combustible metal powder, inert additive, and binder.

Operation of the high voltage flashlamps of FIGS. 1 and 2 is initiated when a high voltage pulse from e.g., a piezoelectric crystal, is applied across the two lead-in wires 8 and 10. Electrical breakdown of the primer causes its deflagration which, in turn, ignites the shredded metallic combustible 18. The scraped off portions 14 on the lead-in wires insure reliability of ignition by providing small areas of direct contact between the bare conductor metal and the primer. It has been observed, however, that reliable ignition can also be obtained if the scraping step is eliminated and the wires 8 and 10 within the envelope are left completely coated with frit 12, without providing non-coated areas 14. It is theorized that such ignition is affected due to the somewhat porous nature of the upper portions of the frit coating which are not completely fused, as discussed in the aforementioned U.S. Pat. No. 4,059,389.

In the lamp of FIG. 2, the spark discharge occurs through the primer bridge 16, and the shreds of foil 18 will tend to be supported in the upper portions of the envelope of the bridge. In the lamp above FIG. 1, however, the foil 18 substantially fills the envelope 2 and is in contact with both of the respective primer coatings 16 so as to form an electrically conducting path therebetween for formation of a spark discharge between the lead-in wires and the foil through the respective primer coatings upon application of a high voltage pulse across the lead-in wires. Hence, in high speed automatic production processing, it is not critical whether the primer bridges the leads or not; it is only necessary that the foil provides contact between the separate primer coatings.

Figure 3:
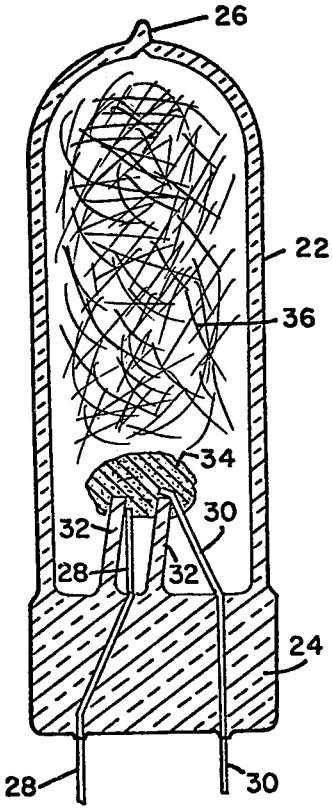
FIG. 3 is an enlarged sectional view of another embodiment of a photoflash lamp in accordance with the invention, wherein one of the lead-in wires has a glass sleeve.

Referring now to the alternative embodiment of FIG. 3, the high voltage type flashlamp illustrated therein comprises an hermetically sealed light-transmitting envelope 22 of glass tubing having a press 24 defining one end thereof and an exhaust tip 26 defining the other end thereof. Supported by the press 24 is an ignition means comprising a pair of lead-in wires 28 and 30 extending through and sealed to the press, an insulating sleeve 32 extending within the envelope about the lead-in wire 28, and a mass of primer material 34 bridging the ends of the lead-in wires within the envelope. The insulating sleeve 32 may be formed of glass or ceramic and is preferably sealed into the envelope press 24 at one end so that only the inward end of the sleeve is open. Lead-in wire 30 passes through the press 24 and is formed so that it rests and terminates at or near the opened end of the sleeve 32. The mass of primer material 34, which may be dip applied, is disposed to substantially cover the open end of the sleeve 32 and bridge the ends of the lead-in wires, as shown in FIG. 3. In accordance with the invention, the composition of primer material 34 includes a finely divided inert additive material as described hereinbefore with respect to primer material 16 in FIGS. 1 and 2.

Typically the lamp envelope 22 has an internal diameter of less than one centimeter and an internal volume of less than 1 cc. A quantity of filamentary combustible fill material 36, such as shredded zirconium of hafnium foil, is disposed within the lamp envelope. The envelope 22 is also provided with a filling of combustion supporting gas, such as oxygen, at a pressure of several atmospheres. Typically, the exterior surface of the glass envelope 22 is also provided with a protective coating, such as cellulose acetate (not shown).

As described for the lamp of FIG. 1, a wet primer mixture may be prepared and then applied, such as by a dip process, to form the ignition mass 34. When dried, the primer shows high ignition sensitivity for high voltage discharge across the lead-in wires.

Operation of the lamp is initiated when a high voltage pulse, from e.g., a piezoelectric crystal, is applied across the two lead-in wires 28 and 30. Electrical breakdown of the primer causes its deflagration which, in turn, ignites the shredded metallic combustible 36.

By way of specific example, a "control" group of fritted lead construction lamps, such as shown in FIG. 1, was primed with the following mixture (shown as weight percentages on a dried basis): 84.14% zirconium powder, 9.95% tungsten trioxide, 0.19% silane adhesion promoter, 3.93% hydrophobic fumed silica and 1.79% nitrocellulose resin. For application, the material was reduced to a 56% solids slurry with methyl cellosolve acetate.

A second "test" group of lamps was primed with a test primer made by adding 30% by dried weight of 30 micron diameter glass microbeads to the above composition. The weight composition of the test primer on a dried basis was 58.91% zirconium powder, 6.96% tungsten trioxide, 0.13% silane adhesion promotor, 2.75% hydrophobic fumed silica, 1.25% nitrocellulose resin, and 30.00% glass microbeads. The lamps of both groups were flashed with the following results.

| Primer | No. Lamps | Breakdown Voltage Avg. | Range | % Lamps < 300 Volts |
|---|---|---|---|---|
| Control | 30 | 245 | 150–2000 | 55 |
| Test | 44 | 520 | 200–1400 | 5 |

These data show the elevation in mean lamp firing or breakdown voltage that results principally from the significant reduction of low breakdown values in the voltage distribution obtained. The fraction of lamps that flash below some given voltage (e.g. 300 volts) is regarded as the most meaningful test parameter.

A convenient means of measuring relative flash reliability of different primers involves flashing test lamps with a standard 2000-volt piezo pulse source and interposing varying degrees of resistance in series with the lamps. Lamps with the above control and test primers (without and with 30% glass microbeads) were subjected to this test. Forty lamps were used for each group.

| Series Resistance ohms | Lamps Flashed Control | Test |
|---|---|---|
| 680,000 | 95.0 | 97.5 |
| 2,700,000 | 87.5 | 95.0 |
| 6,800,000 | 85.0 | 90.0 |

This test shows, surprisingly, that the addition of 30% by weight of inert glass microbeads to the primer did not harm lamp reliability and, in fact, appeared to slightly enhance performance. This test functions by limiting the peak current passed through the lamp after breakdown of the primer has occurred. A considerable history of test data supports the validity of this test method for predicting relative flashing reliability of different lamp construction and primer formulations.

The principal advantage of this invention is that it provides control of brakdown voltage range for high voltage flashlamps of the preferred fritted lead construction, and does so in an inexpensive, production-acceptable way. The resulting beneficiated lamps are less subject to inadvertent ignition on certain camera models and during lamp production itself.

Alternative methods would include the obvious substitution of particulate nonconducting material in other than bead shaped particles. While it is felt that microbeads give more predictable void volume and geometry, and thereby greater freedom from performance idiosyncracies due to lot-to-lot variations, this invention is not intended to be limited solely thereto. The composition of the particulate additive may encompass a variety of materials. Glasses, silica, refractory oxides, and other such materials which are insoluble in the vehicle used, could be substituted. The mean particle size is preferably significantly greater than that of the zirconium (or other combustible metal) powder used. Numerically, the inert particle diameter or mean dimension should average from 10 to 50 times that of the metal powder. In the example cited, the glass microbeads were of 30 microns average diameter and the zirconium powder was about 1.2 microns size. The weight percentage of the inert nonconducting particulate additive may be from 10 to 60 percent on a dried basis. The optimum value is expected to vary with the particle size and shape chosen; for the glass microspheres cited, the optimum content is about 30 percent as shown.

Hence, although the invention has been described with respect to a specific embodiment it will be appreciated that modifications and changes may be made by those skilled in the art without departing from the true spirit and scope of the invention.

What we claim is:

1. A photoflash lamp comprising:

an hermetically sealed, light-transmitting envelope, a quantity of filamentary combustible material located within said envelope;

a combustion-supporting gas in said envelope;

and ignition means disposed in said envelope in operative relationship with respect to said combustible fill material, said ignition means including a pair of lead-in wires extending into said envelope in a spaced relationship, and a dried coating of primer material covering a portion of at least one of said lead-in wires within said envelope, said coating of primer material having been provided from a mixture comprising a particulate fuel, a binding agent, a solvent and a relatively coarse additive of electrically nonconducting inert particulate material;

said additive of inert particulate material being insoluble in said solvent, having a solid particle size which is about 10 to 50 times larger in average diameter than that of said particulate fuel, and being present in an amount from about 10 to 60 weight percent of the dried mixture.

2. The lamp of claim 1 wherein said combustion-supporting gas in said envelope is oxygen at an initial fill pressure exceeding one atmosphere.

3. The lamp of claim 1 wherein said fuel is a combustible metal powder.

4. The lamp of claim 3 wherein said fuel is zirconium powder.

5. The lamp of claim 1 wherein the inert particulate material of said additive is selected from the group consisting of glasses, silica, and refractory oxides.

6. The lamp of claim 1 wherein said additive particles are in the form of microbeads.

7. The lamp of claim 6 wherein said additive comprises glass microbeads.

8. The lamp of claim 1 wherein the average particle size of said fuel is about 1.2 microns diameter, and the average particle size of said additive of inert particulate material is about 30 microns diameter.

9. The lamp of claim 8 wherein said additive comprises glass microbeads and is present in an amount of about 30 weight percent of the dried mixture.

10. The lamp of claim 1 wherein the termination of each of said lead-in wires within said envelope has a smooth and rounded configuration of larger diameter than the remainder of the wire, an insulating material is coated on substantially the full length within the envelope of at least one of said lead-in wires for preventing preignition short circuits through said filamentary combustible material, and said primer material is coated about the smooth and rounded terminations of said lead-in wires, the primer coating on the insulatingly coated lead-in wires being disposed over said coating of insulating material.

11. The lamp of claim 10 wherein said primer material bridges the terminations of said lead-in wires.

12. The lamp of claim 10 wherein the respective primer coatings on said lead-in wires are spaced apart from each other, and said filamentary combustible material substantially fills said envelope and is in contact with both of said respective primer coatings so as to form an electrically conducting path therebetween for formation of a spark discharge between said lead-in wires and the combustible material through said respective primer coatings upon application of a high voltage pulse across said lead-in wires.

13. The lamp of claim 1 further including a sleeve of insulating material extending within said envelope about one of said lead-in wires, said sleeve being sealed to said envelope at one end and open at the other end, the other of said lead-in wires terminating at or near the open end of said sleeve, and said primer material being disposed to substantially cover the open end of said sleeve and bridge the ends of said lead-in wires.

* * * * *